US006776726B2

(12) United States Patent
Sano

(10) Patent No.: US 6,776,726 B2
(45) Date of Patent: Aug. 17, 2004

(54) GOLF CLUB HEAD

(75) Inventor: Yoshinori Sano, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 10/154,831

(22) Filed: May 28, 2002

(65) Prior Publication Data

US 2003/0008726 A1 Jan. 9, 2003

(51) Int. Cl.[7] ..... A63B 53/04
(52) U.S. Cl. ..... 473/330; 473/342; 473/345; 473/349
(58) Field of Search ..... 473/324, 345, 473/346, 329, 330, 349, 350, 290, 291, 292, 342

(56) References Cited

U.S. PATENT DOCUMENTS 4,792,140 A * 12/1988 Yamaguchi
5,405,136 A * 4/1995 Hardman
5,423,535 A * 6/1995 Shaw
5,489,094 A * 2/1996 Pritchett
5,807,190 A * 9/1998 Krumme
5,879,243 A * 3/1999 Hackman
5,961,394 A * 10/1999 Minabe
6,319,150 B1 * 11/2001 Werner

FOREIGN PATENT DOCUMENTS

JP 9-168613 6/1997
JP 10-108927 4/1998

* cited by examiner

*Primary Examiner*—Sebastiano Passaniti
(74) *Attorney, Agent, or Firm*—Birch, Stewart, Kolasch & Birch, LLP

(57) ABSTRACT

A golf club head comprises a ball striking face provided with a central region having a surface hardness Hc and a peripheral region surrounding the central region and having a surface hardness Hp less than the surface hardness Hc.

15 Claims, 3 Drawing Sheets

GOLF CLUB HEAD

BACKGROUND OF THE INVENTION

The present invention relates to a golf club head more particularly to an improved face plate capable of improving the restitution coefficient and hit feeling without sacrificing the durability.

In recent years, in order to withstand a large impact force at the time of hitting a golf ball, a golf club head whose face portion is made of a beta-type titanium alloy, that is, a high strength metallic material, has been proposed.

In such a golf club head, however, as the face portion becomes rigid in its entirety, the restitution coefficient is decreased and hit feeling becomes worse although the durability is improved.

SUMMARY OF THE INVENTION

It is therefore, an object of the present invention to provide a golf club head, in which the restitution coefficient and hit feeling can be improved without sacrificing the durability.

According to the present invention, a golf club head comprises a ball striking face provided with a central region having a surface hardness Hc and a peripheral region surrounding the central region and having a surface hardness Hp less than the surface hardness HC.

Therefore, the restitution coefficient and hit feeling can be improved by a flexural deformation of the peripheral region at the time of hitting a golf ball, and as the central region having a relatively high surface hardness provides strength, the durability can be maintained.

DEFINITIONS

Figure 1:
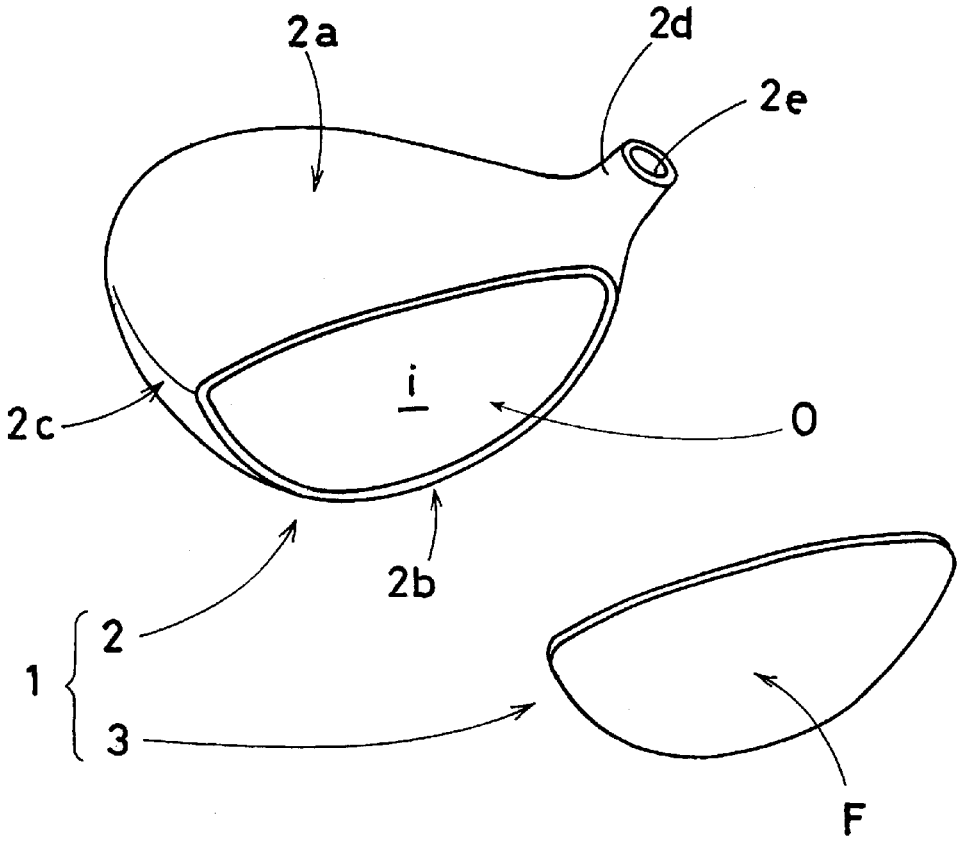
FIG. 1 is an exploded view of a golf club head according to the present invention.

Surface hardness: The surface hardness which is measured according to the Japanese Industrial Standard Z2244 "Vickers hardness test", under a load of 50 gf (0.4903N) and a holding time of ten seconds.

Measuring state: A state of a golf club head such that the golf club head is put on a horizontal plane HL while keeping its lie angle alpha and loft angle beta.

DESCRIPTION OF THE PREFERRED EMBODIMENT(S)

Taking a wood-type golf club head as example, an embodiment of the present invention will now be described in detail in conjunction with the accompanying drawings.

In the drawings, a wood-type golf club head 1 according to the present invention comprises a head main body 2 and a face plate 3 whose outer surface defines a ball striking face F for striking a golf ball.

The head main body 2 has a hollow (i) opened at the front thereof and comprises a crown portion 2*a*, a sole portion 2*b* and a side portion 2*c* surrounding the hollow (i). The side portion 2*c* extends between the crown portion 2*a* and the sole portion 2*b* excepting the front to form the opening (O) to be closed by the face plate 3. Further, a protruding hosel 2*d* is provided on the heel side of the head main body 2. The hosel 2*d* is provided with a shaft inserting hole 2*e* of which center line CL is used as the reference line for the lie angle in setting the golf club head in the above-mentioned measuring state.

The head main body 2 can be made of a metallic material such as an aluminum alloy, pure titanium, titanium alloy, stainless and the like. In this embodiment, the head main body 2 is formed as monoblock by lost-wax precision casting of an alpha-beta-type titanium alloy Ti-6Al-4V. It is however also possible to employ other methods aside from lost-wax precision casting.

The face plate 3 has a substantially constant thickness (t) and it is fixed to the front edge of the head main body 2 around the opening (O) by means of welding, adhesive, press fitting or the like, whereby the face plate 3 defines the face portion 3*a* of the club head whose outer surface is the above-mentioned ball striking face F.

The thickness (t) of the face plate 3 is set in a range of from 1.0 to 4.0 mm, preferably 2.0 to 3.2 mm. If the thickness (t) is less than 1.0 mm, it is difficult to obtain sufficient durability or strength. If the thickness (t) is more than 4.0 mm, the restitution coefficient is liable to decrease. In this example, the face F is flat and smooth. The face plate 3 is not provided in the face F with any groove such as notch, serration and the like in order to avoid stress concentration thereon at the time of striking a golf ball, which helps the improvement in the durability.

The face plate 3 is made of a beta-type titanium alloy including an element such as vanadium (V), molybdenum (Mo) or the like which can make beta-solid solution in a metastable state at a room air temperature together with titanium.

In this example, Ti-15V-3Cr-3Al-3Sn is used. But, it is also possible to use other beta-type titanium alloys such as Ti-22V-4Al, Ti-15Mo-5Zr-3Al, Ti-13V-11Cr-3Al, Ti-8Mo-8V-2Fe-3Al, Ti-3Al -8V-6Cu-4Mo-4Zr, Ti-11.5Mo-6Zr-4.5Sn, Ti-15Mo-5Zr and the like.

In this embodiment, the entirety of the face plate 3 is made of one kind of beta-type titanium alloy. In case of beta-type titanium alloys, plastic forming can be easily made by for example, cold forging, cold press working, etc. in comparison with alpha-beta-type titanium alloys. In case of plastic forming, it is easy to control the crystallographic structure of the metal in comparison with casting. Therefore, in making the face plate 3, such plastic forming is used.

Figure 2:
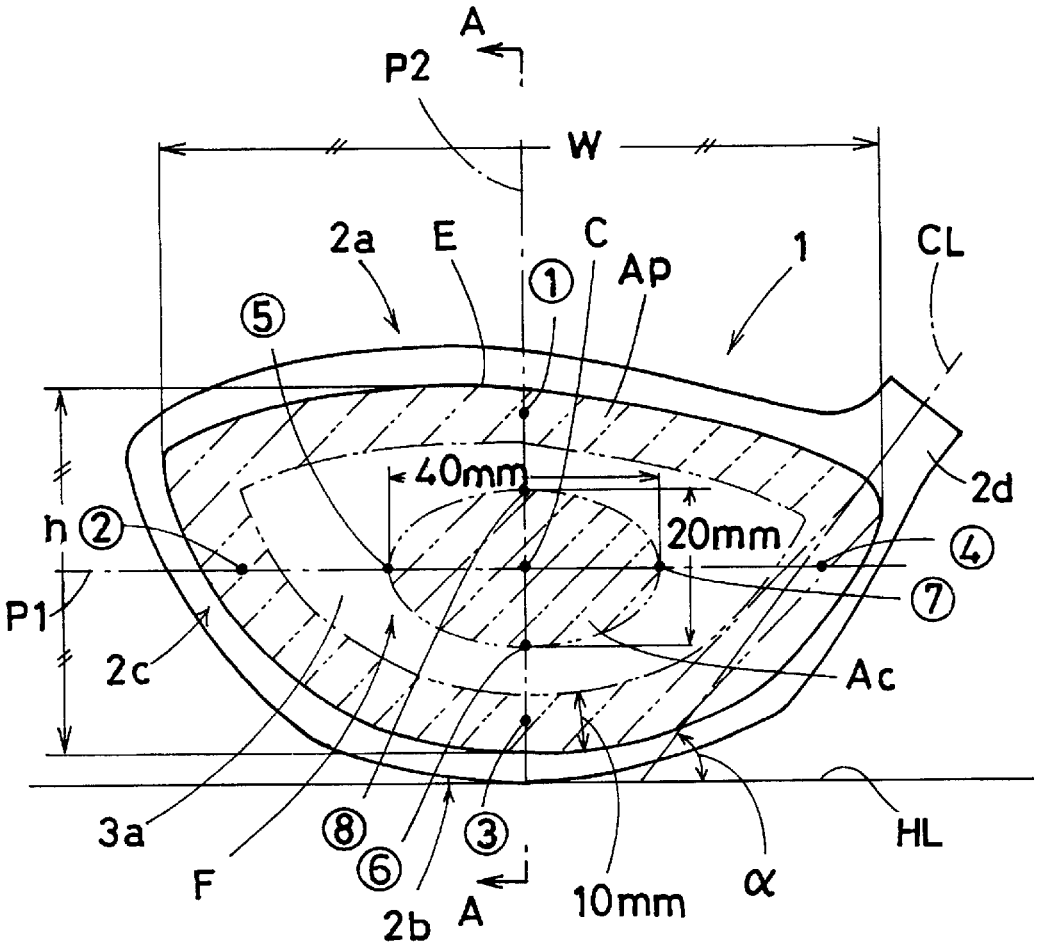
FIG. 2 is a front view of the golf club head under the measuring state.
Figure 3:
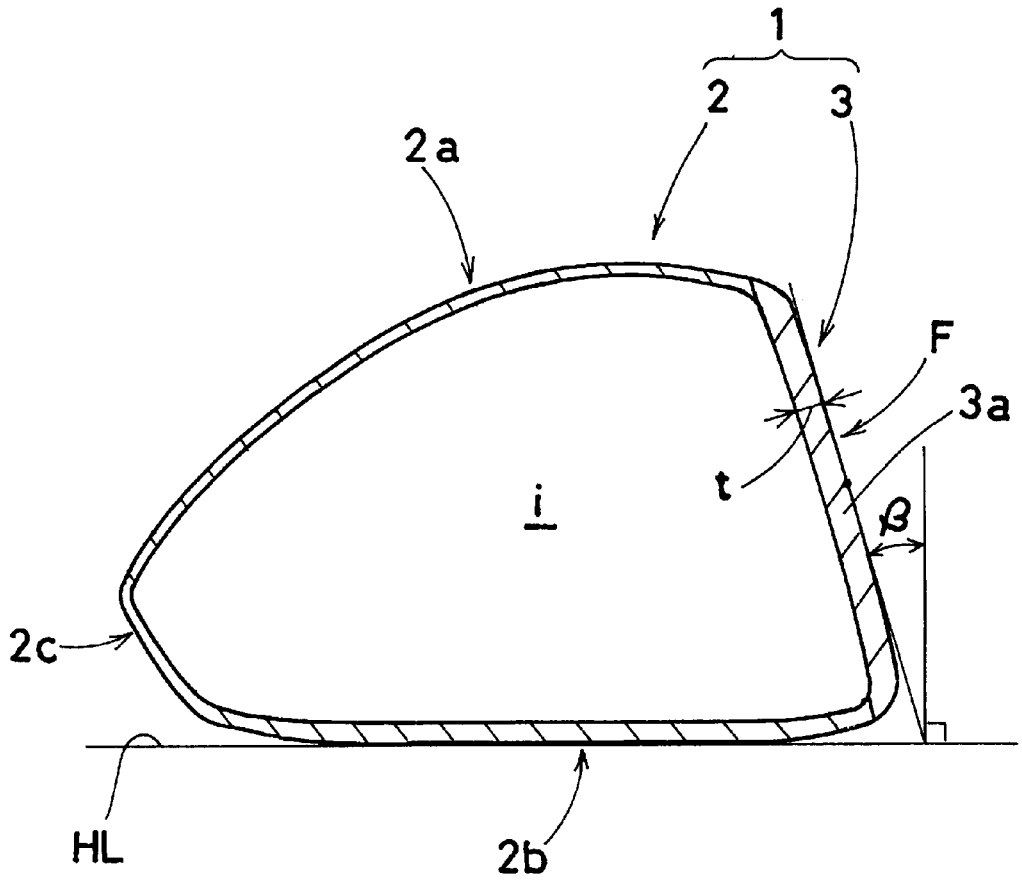
FIG. 3 is a cross sectional view of the golf club head taken along a line A—A in FIG. 2.

As shown in FIG. 2, in the measuring state of the golf club head 1, the face height (h) which is the maximum height of the face F occurring in the vertical direction to the horizontal plane HL, is set in a range of from 40 to 60 mm, preferably 45 to 60 mm. The face width (w) which is the maximum width of the face F occurring in the horizontal direction, is set in a range of from 80 to 130 mm, preferably 90 to 130 mm. The surface area of the face F is preferably not less than 20 sq.cm, more preferably 30 to 50 sq.cm.

The surface hardness Hp of a peripheral region Ap of the face F is set to be less than the surface hardness Hc of a central region AC of the face F.

The peripheral region Ap is an annular region formed along the edge E of the face F as extending at least 10 mm inward from the edge E. Here 10 mm is the measurement in the normal direction to the edge E.

The central region Ac is an oval region, the oval of which has a major axis in the horizontal direction whose length is 40 mm, a minor axis in the vertical direction whose length is 20 mm, and the origin at a center C of the face F. The center c is defined as an intersecting point of the face F, a horizontal plane P1 which bisects the face height (h) and a vertical plane P2 which bisects the face width (w).

Preferably, the ratio (Hp/Hc) of the surface hardness Hp to the surface hardness Hc is set in a range of from 0.45 to 0.90, more preferably 0.51 to 0.87, still more preferably 0.55 to 0.75. If the Hp/Hc ratio decreases under 0.45, cracks or breakage is liable to occur in the face portion 3*a*. If the Hp/Hc ratio increases over 0.90, there is a tendency to deteriorate the restitution coefficient and hit feeling.

In this embodiment, an annular region is formed between the central region AC and the peripheral region Ap, and the surface hardness of this region is set to be the substantially same as that of the peripheral region Ap or between Hc and Hp.

As to the surface hardness Hc of the central region AC where the golf balls mainly hit, an excessively high surface hardness HC tends to render the hit feeling unpleasant for many golfers. However, an insufficient surface hardness Hc tends to cause cracks, breakage, dent and the like. Therefore, it is preferable for the central region Ac that the surface hardness Hc is set in a range of from 250 to 600 Hv, more preferably 300 to 500 Hv, still more preferably 300 to 450 Hv.

As to the surface hardness Hp of the peripheral region Ap, on the other hand, an excessively high surface hardness Hp tends to decrease the restitution coefficient. But if the surface hardness Hp is too low, the strength in the face portion 3*a* becomes insufficient. Therefore, it is preferable for the peripheral region Ap that the surface hardness Hp is set in a range of from 200 to 300 Hv, more preferably 200 to 260 HV, still more preferably 230 to 260 Hv.

This golf club head 1 having the above-mentioned hardness distribution can be made by (1) welding the face plate 3 and head main body 2 together to make a golf club head basal body, (2) trimming, grinding and/or polishing the welded part and other part if necessary, (3) making a solution heat treatment and an aging treatment for the entirety of the golf club head basal body, and (4) making a peripheral heating treatment.

The solution heat treatment is to heat the face plate, in this example the entirety of the golf club head basal body, at a temperature of about 800 degrees C. for some time about 0.5 to 1.0 hours and then quench or rapidly cool down to a room air temperature, whereby the face plate material made from a beta-type titanium alloy can solidify in a state where deposit substance, carbide, etc. are uniformly melted into the alloy, namely, the face plate is precipitation hardened.

In this stage, however, the face plate 3 is not provided with a sufficient strength yet. Therefore, the aging treatment is made.

The aging treatment is to heat the face plate, in this example the entirety of the golf club head basal body, at a temperature of about 500 degrees C. for a relatively long time in a range of 4 to 20 hours and then air-cool (slow cool), whereby minute alpha-type intermetallic compound, etc. are deposited in the face plate material and the strength and hardness thereof are raised, namely, the material of the face plate is age-hardened.

After the above-mentioned solution heat treatment and aging treatment, the peripheral heating treatment is made.

The peripheral heating treatment is a local treatment by which only the peripheral region Ap is heated at a specific temperature for a short time and then quenched.

The heating time is set in a range of 1 to 5 minutes to avoid an excessive temperature rise in other portion than the peripheral region Ap.

The temperature is set to be more than the transformation temperature to beta type but less than the melting temperature. In case of Ti-15v-3Cr-3Al-3Sn, the temperature is set in a range of from 750 to 1000 degrees C. such localized heating is possible by irradiating a high-energy laser beam such as ruby laser, YAG laser, Co2 laser and the like or electron beam to the peripheral region Ap.

Aside from the heating by such a high-energy beam, the following method may be also possible as another example of the localized heating: first putting a molten metal on only the peripheral region Ap, then removing the metal into the smooth surface, and, if necessary polishing the surface.

In quenching the heated region, it is better to use a coolant such as cooling water.

In any case, in the peripheral region Ap, the above-mentioned minute alpha-type intermetallic compound produced during the aging treatment disappears and again the material becomes substantially homogeneous beta-solid solution. In the central region Ac, on the other hand, as the localized heating treatment is not made, the above-mentioned minute alpha-type intermetallic compound still remains therein. As a result, the surface hardness becomes lower in the peripheral region Ap than the central region AC.

Comparison Tests

Golf club heads having the structure shown in FIG. 1 and specifications shown in Table 1 were made and the following tests were conducted.

Excepting Ref. 2, after the face plate and head main body were welded together into a golf club head basal body, the solution heat treatment and aging treatment were made on the golf club head basal body. In Ref. 2, first the solution heat treatment and aging treatment were made on only the face plate and then the face plate and head main body were welded together.

Surface Hardness Test: The surface hardness of the ball striking face was measured using a microhardness testing machine "HMV-2000" manufactured by shimadzu corporation. In the peripheral region, the measurement was made at four positions indicated in FIG. 2 as ① to ④ and their average is shown in Table 1. In the central region, the measurement was made at five positions indicated in FIG. 2 as ⑤ to ⑧ and "C" (center) and their average is shown in Table 1.

Impact Resistance Test: Each of the golf club heads and a shaft were assembled into a wood club. The club was attached to a swing robot and repeatedly struck a commercially available two-piece ball at a head speed of 50 m/s while counting up the number of times until the face plate was broken. The results are shown in Table 1, wherein "A" indicates the counting was 5000 or more, and "B" indicates the counting was under 5000.

Restitution Coefficient Test:

According to the "Procedure for Measuring the Velocity Ratio of a Club Head for Conformance to Rule 4-1e, Appendix II, Revision 2 (Feb. 8, 1999), United States Golf Association", the restitution coefficient (e) of each club head was obtained. The results are shown in Table 1.

Feeling Test: Ten golfers whose handicaps ranged from 0 to 5 evaluated the hit feeling of each club into three ranks A, B and C after the hitting was made ten times per each club. The results are shown in Table 1.

TABLE 1

| Club Head | Ex. 1 | Ex. 2 | Ex. 3 | Ex. 4 | Ex. 5 | Ex. 6 | Ref. 1 | Ref. 2 | Ref. 3 | Ref. 4 | Ref. 5 |
|---|---|---|---|---|---|---|---|---|---|---|---|
| Face plate | | | | | | | | | | | |
| Material *1 | | | | | | | | | | | |
| Thickness T (mm) | 2.8 | 3.2 | 3.7 | 1.0 | 2.0 | 2.8 | 2.8 | 2.8 | 0.8 | 4.2 | 2.8 |
| Surface area (sq. cm) | 35 | 35 | 35 | 35 | 35 | 22 | 35 | 35 | 35 | 35 | 15 |
| Solution heat treatment | | | | | | | | | | | |
| Temperature (deg. C.) | 760 | 815 | 820 | 760 | 760 | 760 | 815 | 760 | 815 | 815 | 815 |
| Time (hr) | 1.0 | 0.5 | 0.5 | 1.0 | 1.0 | 1.0 | 0.5 | 0.5 | 0.5 | 0.5 | 0.5 |
| Cooling | rapid | rapid | rapid | rapid | rapid | rapid | rapid | rapid | rapid | rapid | rapid |
| Aging treatment | | | | | | | | | | | |
| Temperature (deg. C.) | 500 | 510 | 600 | 500 | 500 | 500 | 510 | 480 | 510 | 510 | 510 |
| Time (hr) | 20 | 8 | 4 | 20 | 20 | 20 | 8 | 20 | 8 | 8 | 8 |
| Cooling | slow | slow | slow | slow | slow | slow | slow | slow | slow | slow | slow |
| Peripheral heating treatment | | | | | | | non | non | non | non | non |
| Temperature (deg. C.) | 775 | 800 | 800 | 775 | 775 | 775 | | | | | |
| Time (min) | 3 | 3 | 4 | 1 | 2 | 3 | | | | | |
| Cooling | rapid | rapid | rapid | rapid | rapid | rapid | | | | | |
| Ball striking face | | | | | | | | | | | |
| Central region | | | | | | | | | | | |
| Hardness Hc (Hv) | 452 | 420 | 301 | 449 | 452 | 451 | 421 | 500 | 458 | 453 | 454 |
| Peripheral region | | | | | | | | | | | |
| Hardness Hp (Hv) | 231 | 259 | 262 | 231 | 231 | 228 | 402 | 199 | 234 | 231 | 232 |
| Hp/Hc | 0.51 | 0.62 | 0.87 | 0.51 | 0.51 | 0.51 | 0.95 | 0.40 | 0.51 | 0.51 | 0.51 |
| Impact resistance | A | A | A | B | A | A | A | C | C | A | A |
| Restitution coefficient | 0.818 | 0.815 | 0.814 | 0.852 | 0.838 | 0.811 | 0.810 | 0.820 | 0.855 | 0.801 | 0.803 |
| Hit feeling | A | A | B | A | A | A | C | A | A | B | B |

*1 Face plate material: Ti-15V-3Cr-3Al-3Sn
Head main body material: Ti-6Al-4V

From the test results, it was confirmed that golf club heads according to the present invention can be improved in the restitution coefficient and hit feeling without sacrificing the durability.

The present invention can be applied to not only the wood-type golf club heads but also other types of golf club heads such as iron-type and utility type as far as there is a hollow or cavity at the back of the face plate.

What is claimed is:

1. A golf club head comprising:

a face plate made of a metal material and defining a ball striking face, said ball striking face provided with a central region having a surface hardness and a peripheral region surrounding the central region and having a surface hardness, wherein the surface hardness is measured on the ball striking face according to a test method specified in the Japanese Industrial Standard Z2244 "Vickers hardness test" under a load of 50 gf ( 0.4903N) and a holding time of ten seconds, wherein said surface hardness of the central region is in a range of 250 to 600 Hv, and said surface hardness of the peripheral region is in a range of from 0.45 to 0.90 times the surface hardness of the central region.

2. A golf club head according to claim 1, wherein the ball striking face has a height in a range of from 40 to 60 mm and a width in a range of from 80 to 130 mm.

3. A golf club head according to claim 1, wherein the peripheral region is an annular region extending at least 10 mm inward from the edge of the ball striking face, and the central region is an oval region having the major axis in the horizontal direction and the minor axis in the vertical direction, and the length of the major axis is 40 mm and the length of the minor axis is 20 mm.

4. A golf club head according to claim 1, 2 or 3, wherein the ball striking face is smooth being devoid of any groove.

5. A golf club head according to claim 1, 2 or 3, wherein said metal material is a beta-type titanium alloy.

6. A golf club head according to claim 1, wherein the thickness of the face plate is set in a range of from 1.0 to 4.0 mm.

7. A golf club head according to claim 1, wherein the thickness of the face plate is set in a range of from 2.0 to 3.2 mm.

8. A golf club head according to claim 1, wherein the ball striking face height is set in a range of from 45 to 60 mm, and wherein the ball striking face width is set in a range of from 90 to 130 mm.

9. A golf club head according to claim 1, wherein said surface hardness of the peripheral region is in a range of from 0.51 to 0.87 times the surface hardness of the central region.

10. A golf club head according to claim 1, wherein said surface hardness of the peripheral region is in a range of from 0.55 to 0.75 times the surface hardness of the central region.

11. A golf club head according to claim 1, wherein the surface hardness of the central region is in a range of 300 to 500 Hv.

12. A golf club head according to claim 1, wherein the surface hardness of the central region is in a range of 300 to 450 Hv.

13. A golf club head according to claim 1, wherein the surface hardness of the peripheral region is in a range of from 200 to 300 Hv.

14. A golf club head according to claim 1, wherein the surface hardness of the peripheral region is in a range of from 200 to 260 Hv.

15. A golf club head according to claim 1, wherein the surface hardness of the peripheral region is in a range of from 230 to 260 Hv.

* * * * *